US008565648B2

(12) United States Patent
Furubayashi et al.

(10) Patent No.: US 8,565,648 B2
(45) Date of Patent: Oct. 22, 2013

(54) CHARGE ELEMENT, PROCESS CARTRIDGE, AND IMAGE FORMING APPARATUS

(75) Inventors: Hiroki Furubayashi, Atsugi (JP); Tadayuki Oshima, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 187 days.

(21) Appl. No.: 13/092,189

(22) Filed: Apr. 22, 2011

(65) Prior Publication Data

US 2011/0286763 A1 Nov. 24, 2011

(30) Foreign Application Priority Data

May 19, 2010 (JP) ..... 2010-115432

(51) Int. Cl.
*G03G 15/02* (2006.01)

(52) U.S. Cl.
CPC ..... *G03G 15/025* (2013.01)
USPC ..... 399/168; 399/176

(58) Field of Classification Search
USPC ..... 399/115, 168, 174, 176
See application file for complete search history.

(56) References Cited

U.S. PATENT DOCUMENTS

| | | | | |
|---|---|---|---|---|
| 7,460,815 | B2 | 12/2008 | Kamoshida et al. | |
| 7,483,652 | B2 | 1/2009 | Higaki | |
| 2004/0109706 | A1 * | 6/2004 | Kosuge et al. | 399/168 |
| 2005/0129426 | A1 * | 6/2005 | Tsunemi et al. | 399/159 |
| 2007/0092298 | A1 * | 4/2007 | Kamoshida et al. | 399/168 |
| 2009/0274487 | A1 | 11/2009 | Nakamura et al. | |

FOREIGN PATENT DOCUMENTS

| | | |
|---|---|---|
| JP | 2006-162646 | 6/2006 |
| JP | 2007-121480 | 5/2007 |
| JP | 2009-271131 | 11/2009 |

* cited by examiner

*Primary Examiner* — Walter L Lindsay, Jr.
*Assistant Examiner* — Jessica L Eley
(74) *Attorney, Agent, or Firm* — Cooper & Dunham LLP

(57) ABSTRACT

A charge element includes an element body in parallel to a photoreceptor element and biased to the photoreceptor element by an elastic element, and a gap retainer unit provided on the element body, contacting with an outer face of the photoreceptor element to constantly retain a gap between an outer face of the element body and the outer face of the photoreceptor element, and comprising a first gap retainer element provided on the element body and a second gap retainer element provided on the first gap retainer element and made of a material softer than that of the first gap retainer element and that of the outer face of the photoreceptor element.

9 Claims, 6 Drawing Sheets

CHARGE ELEMENT, PROCESS CARTRIDGE, AND IMAGE FORMING APPARATUS

CROSS REFERENCE TO RELATED APPLICATION

The present application is based on and claims priority from Japanese Patent Application No. 2010-115432, flied on May 19, 2010, the disclosure of which is hereby incorporated by reference in its entirety.

BACKGROUND OF THE INVENTION

1. Field of the Invention

The present invention relates to a charge element which evenly charges the outer face of a photoreceptor element as a photoreceptor drum used in a copier, a facsimile machine, a printer or a combined machine as well as to a process cartridge including the charge element, and an image forming apparatus including the process cartridge.

2. Description of the Prior Art

In prior art an electrophotographic image forming apparatus such as a copier, a facsimile machine, a printer or a combined machine comprises a photoreceptor drum on which an electrostatic latent image is formed, a charge roller evenly charging the outer face of the photoreceptor drum, an optical write unit exposing the evenly charged outer face of the photoreceptor element to form an electrostatic latent image, a develop unit developing the electrostatic latent image to form a toner image, a transfer unit transferring the toner image onto a paper sheet, and a cleaning unit removing remnant toner from the outer face of the photoreceptor drum after the transfer.

A contact type charge unit is generally used, comprising a charge roller contacting with the surface of the photoreceptor drum and a power source to apply direct voltage or alternating voltage to the charge roller. In this charge unit the charge roller is applied with the direct or alternating voltage to evenly charge the photoreceptor drum at a high voltage. It is known that the charge mechanism of the charge roller is an electric discharge according to Paschen's law in a finite space between the charge roller and the photoreceptor drum.

However, the contact type charge unit has various problems that due to the contact between the charge roller and the photoreceptor drum, a material composing the charge unit may exude and attach to the surface of the photoreceptor drum or a trace of the contacting charge unit may remain thereon. Moreover, other problems are noise from a vibrating charge unit when applied with an alternating voltage, a decrease in chargeability of the charge roller due to attached toner caused by the exuding material, and permanent deformation of the charge roller when the photoreceptor drum stops operating in a long period of time. In view of solving the problems, Japanese Patent Application Publication No. 2006-162646 (Reference 1), No. 2007-121480 (Reference 2), No. 2009-271131 (Reference 3) disclose a charge unit in which a charge unit and a photoreceptor drum are arranged with a distance between them, for example.

The charge roller in this charge unit comprises a body in parallel to the photoreceptor drum, gap retainer elements at both ends of the body and whose diameter is larger than that of the body, and a bias element biasing the body to the photoreceptor drum to allow the gap retainer elements to closely contact with the surface of the photoreceptor drum. The body and the photoreceptor drum are disposed with a distance and the distance may change owing to smudge or smear on the body and the photoreceptor drum, causing unevenness in charging. In the charge unit disclosed in the above references, the photoreceptor drum is evenly charged by superposing direct voltage and high alternating voltage on the body of the charge roller.

However, there still remains a problem that the appliance of the alternating voltage to the roller body may cause contaminant as a discharge product on the photoreceptor drum to disperse between the body and the photoreceptor drum and accumulate on the surface of the body over time. This causes unevenness in resistance of the surface of the body and uneven discharge, resulting in generation of a defective image.

In order to reduce the amount of contaminant on the photoreceptor drum, the charge roller can be disposed as far as possible from the photoreceptor drum. However, this requires an increase in the alternating voltage which is likely to cause anomalous discharge due to leak current, resulting in generation of a defective image including white dots.

In the meantime, the surface layer of the above charge roller (roller body) is made of conductive materials such as Ketjen Black®EC, conductive carbon as acetylene black, conductive polymer as polyaniline, polypyrrole, polyacetylene, and inorganic ion-conducting materials as sodium perchlorate, lithium perchlorate, calcium perchlorate, lithium chloride. By use of the conductive carbon, anomalous discharge due to the leak current is likely to occur, which may likely generate defective images including white dots. By use of the ion-conducting materials, since they are dispersible (soluble) in molecule level, anomalous discharge due to the leak current is unlikely to occur, preventing generation of defective images. The surface layer of the roller body disclosed in Reference 3 is made of ion-conducting materials with low resistance so that the charge roller can exert good chargeability even with a change in the distance from the photoconductor drum.

However, the charge unit in Reference 3 still faces a problem that at the beginning of usage (hereinafter, initial usage period), the surface of the roller element gets contaminated gradually over time. The contamination on the roller surface prevents the photoreceptor drum from being properly charged and causes anomalous discharge.

SUMMARY OF THE INVENTION

The present invention aims to provide a charge unit which can prevent anomalous electric discharge especially in the initial usage period as well as a process cartridge incorporating such a charge unit and an image forming apparatus incorporating such a process cartridge.

According to one aspect of the present invention, a charge unit comprises an element body in parallel to a photoreceptor element and biased to the photoreceptor element by an elastic element, and a gap retainer unit provided on the element body, contacting with an outer face of the photoreceptor element to constantly retain a gap between an outer face of the element body and the outer face of the photoreceptor element, and comprising a first gap retainer element provided on the element body and a second gap retainer element provided on the first gap retainer element and made of a material softer than that of the first gap retainer element and that of the outer face of the photoreceptor element.

BRIEF DESCRIPTION OF THE DRAWINGS

Features, embodiments, and advantages of the present invention will become apparent from the following detailed description with reference to the accompanying drawings.

DETAILED DESCRIPTION OF THE PREFERRED EMBODIMENT

Figure 1:
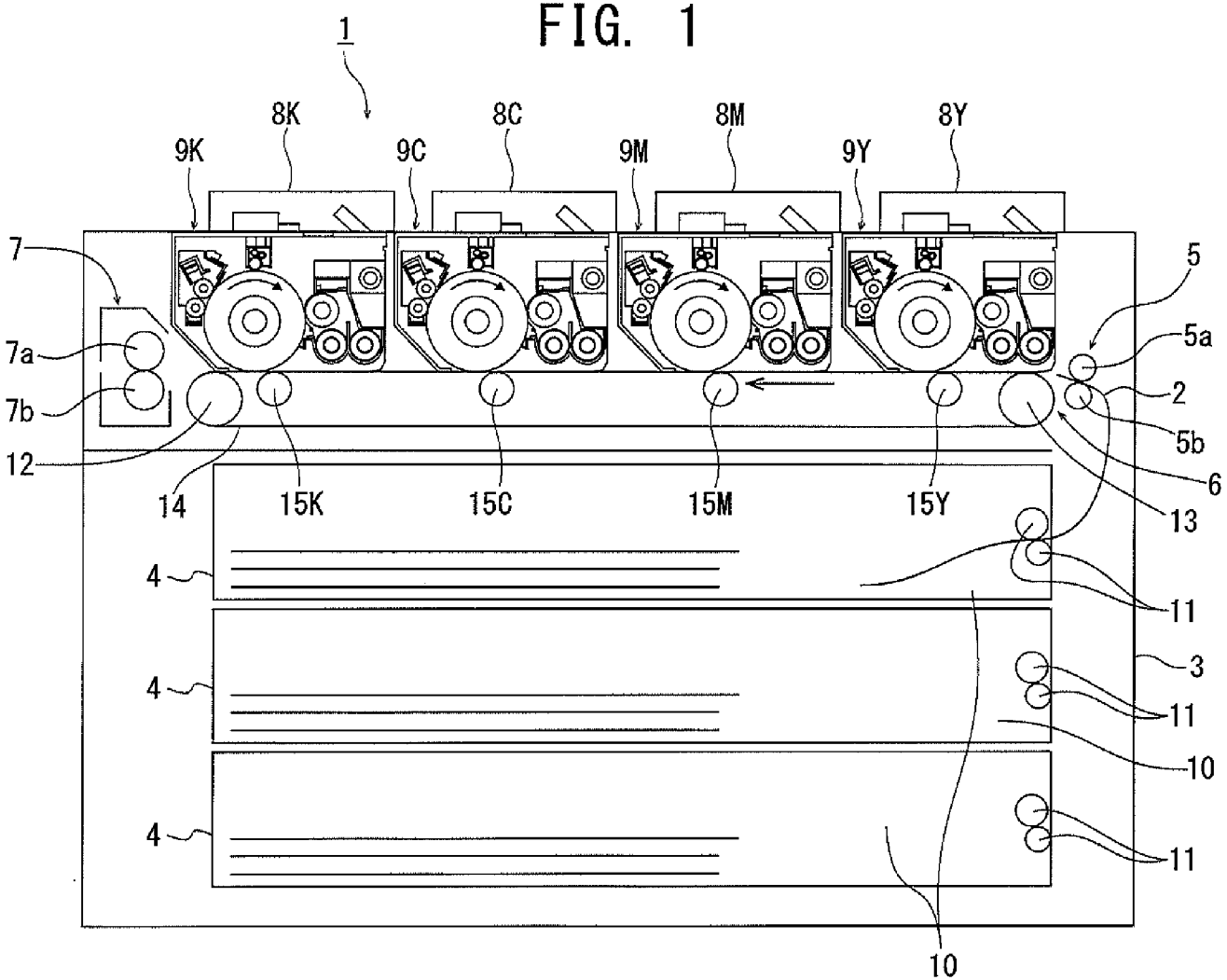
FIG. 1 is a front view of a structure of an image forming apparatus including a lubricant coating unit according to one embodiment of the present invention.
Figure 2:
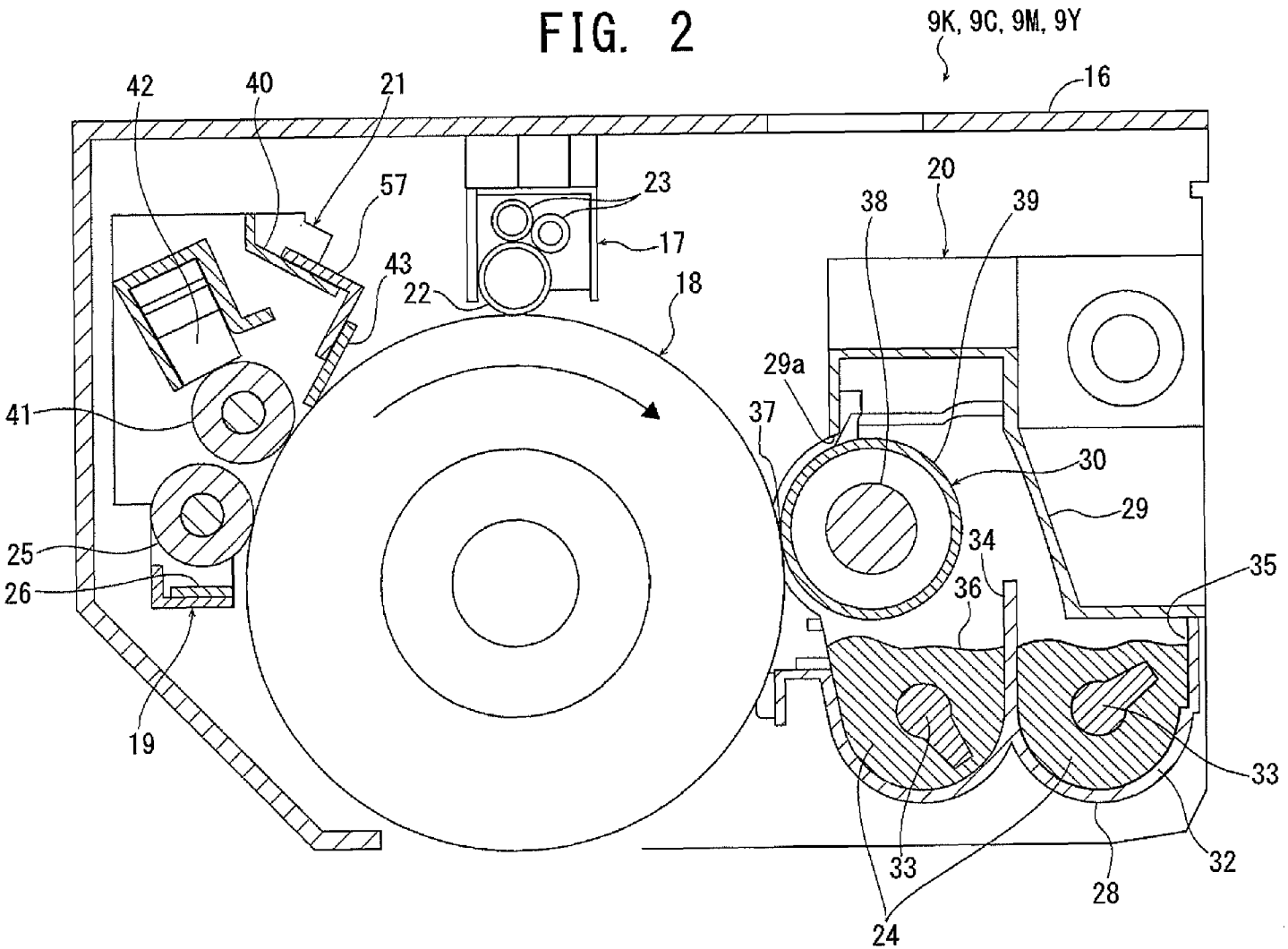
FIG. 2 cross-sectionally shows a process cartridge of the image forming apparatus in FIG. 1.

Hereinafter, one embodiment of the present invention will be described in detail with reference to FIG. 1 to FIG. 5. FIG. 1 shows the structure of an image forming apparatus according to one embodiment of the present invention. FIG. 2 is a cross-sectional view of a process cartridge of the image forming apparatus in FIG. 1 according to one embodiment of the present invention.

In FIG. 1 an image forming apparatus 1 is configured to generate a full color image of yellow (Y), magenta (M), cyan (C), black (K) on a sheet of paper 2. Herein, units associated with these colors are given numeric codes with Y, M, C, K at the end.

The image forming apparatus 1 comprises a body 3, paper feeder units 4, a resist roller pair 5, a transfer unit 6, a fuse unit 7, four laser write units 8Y, 8M, 8C, 8K and four process cartridges 9Y, 9M, 9C, 9K.

A body 3 in a box shape for example is placed on the floor or the like and contains the paper feeder units 4, resist roller pair 5, transfer unit 6, fuse unit 7, laser write units 8Y, 8M, 8C, 8K, and process cartridges 9Y, 9M, 9C, 9K.

The paper feeder units 4 are provided at the bottom of the body 3 to contain a pile of paper sheets 2, and comprise detachable paper cassettes 10 and feed rollers 11. The feed rollers 11 feed the topmost paper sheets 2 to between the resist roller pairs.

The resist roller pair 5, rollers 5*a*, 5*b*, is provided on a carrier path of the paper sheet 2 from the paper feeder units 4 to the transfer unit 6. The rollers 5*a*, 5*b* hold a paper sheet 2 between them and transmit it to between the transfer unit 6 and the process cartridges 9Y, 9M, 9C, 9K at a timing when a toner image is formed.

The transfer unit 6 is provided above the paper feeder units 4 and comprises a drive roller 12, a driven roller 13, a transfer belt 14, and transfer rollers 15Y, 15M, 15C, 15K. The drive roller 12 is placed downstream of a delivery direction of the paper sheet 2 and rotated by a motor or the like.

The driven roller 13 is rotatably supported by the body 3 and placed upstream of the delivery direction of the paper sheet 2. The transfer belt 14 is a loop and extends around the drive roller 12 and the driven roller 13. By rotation of the drive roller 12, the transfer belt 14 rotates counterclockwise in the drawing.

The paper sheet 2 on the transfer belt 14 is carried between the transfer rollers 15Y, 15M, 15C, 15K and the photoreceptor drums 18 of the process cartridges 9Y, 9M, 9C, 9K.

Toner images on the photoreceptor drums 18 are transferred onto the paper sheet 2 by the transfer rollers 15Y, 15M, 15C, 15K. The transfer unit 6 transmits the paper sheet 2 having the toner image thereon to the fuse unit 7.

The fuse unit 7 is provided downstream of the delivery direction of the paper sheet 2, and comprises a roller pair 7*a*, 7*b* to press and apply heat to the paper sheet 2 sent from the transfer unit 6 to fuse the toner image on the paper sheet 2.

The laser write units 8Y, 8M, 8C, 8K are provided above the body 3 in association with the process cartridges 9Y, 9M, 9C, 9K to irradiate with laser the photoreceptor drums 18 uniformly charged by the charge units 17 and generate an electrostatic latent image. In the present embodiment, in addition to the laser write units, an exposure unit comprising an LED array and an imaging portion can be used.

The process cartridges 9Y, 9M, 9C, 9K are arranged between the transfer unit 6 and the laser write units 8Y, 8M, 8C, 8K in the delivery direction of the paper sheet 2. They are detachable from the body 3.

As shown in FIG. 2, the process cartridges 9Y, 9M, 9C, 9K each comprise a cartridge case 16, a charge unit 17, the photoreceptor drum 18, a cleaning blade 19, a develop unit 20 and a lubricant coating unit 21. The image forming apparatus 1 comprises charge rollers 22 as a charge element, the photoreceptor drums 18, cleaning blades 19, develop units 20 and lubricant coating units 21.

The cartridge cases 16 detachable from the body 3 each contain the charge unit 17, photoreceptor drum 18, cleaning blade 19, develop unit 20 and lubricant coating unit 21.

The charge units 17 evenly charge the surfaces of the photoreceptor drums 18. The structure of the charge unit 17 will be described later.

The photoreceptor drums 18 as photoreceptor element are each made of a conductive support element in diameter of about 30 mm to 100 mm on which a photoreceptive layer and a surface layer are overlaid. The photoreceptive layer is made of a photosensitive material. The support element is made of a conductive metal such as aluminum, aluminum alloy, nickel, stainless steel. The photoreceptive layer can be a single layer type in which charge generation material and charge transport material are integrated functionally, or a double layer, functional separation type of a charge generation layer and a charge transport layer.

In a typical functional separation type photoreceptor drum the charge generation layer is directly or via an intermediate layer overlaid on the support element, and the charge transport layer containing charge transport material is overlaid on the charge generation layer. The functional separation type photoreceptive layer is preferable for the photoreceptor drum 18 since it provides a higher degree of freedom in terms of photosensitivity. The surface layer entirely covers the photoreceptive layer, and is made of a synthetic resin such as polycarbonate, for example. The photoreceptor element can be a photoreceptive belt.

The photoreceptor drum 18 is a cylindrical or columnar rotatable element disposed with a gap from a develop roller 30. The surface thereof contacts with the transfer belt 14. Charged by the charge unit 17 uniformly, electrostatic latent images are generated by the optical write units 8Y, M, 8C, 8K on areas R1 of the surfaces of the photoreceptor drums excluding both longitudinal ends (FIG. 3; hereinafter, image formed area), respectively. Toner of a developer 24 is attracted onto the electrostatic latent images on the image formed areas R1 to generate toner images. The toner images are transferred onto the paper sheet 2 on the transfer belt 14.

The cleaning unit 19 comprises a cleaning roller 25 and a coil 26. The cleaning roller 25 is columnar in parallel to and in contact with the photoreceptor drum 18, and rotatably supported by a later-described coating case 40.

The cleaning roller 25 rotates along with the photoreceptor drum 18 to remove remnant toner from the surface of the photoreceptor drum 18 after the transfer of the toner image to the paper sheet 2. The coil 26 recovers the remnant toner removed by the cleaning roller 25.

The develop unit 20 in FIG. 2 comprises a developer supply unit 28, a housing 29, a develop roller 30, and a not-shown doctor blade.

The developer supply unit 28 comprises a container 32 and a pair of agitation screws 33. The container 32 is in a box shape in a length almost equal to the length of photoreceptor drum 18 in an axial direction and includes a partition 34 extending in a longitudinal direction to divide inside of the container 32 into a first area 35 and a second area 36. The first and second areas 35, 36 communicate with each other.

The container 32 contains developer including magnetic carrier and toner in the first and second areas 35, 36. Toner is supplied to one end of the first area in a longitudinal direction when needed and it is fine spherical particles manufactured by emulsion polymerization method or suspension polymerization method. It can be made by pulverizing a synthetic resin lump in which various dyes or pigments are mixed and dispersed or other pulverizations. The average particle size of the toner is 3 μm or more and 7 μm or less.

Magnetic carrier (magnetic powder) is contained in the first and second areas 35, 36 and the average particle size thereof is 20 μm or more and 50 μm or less.

The agitation screws 33 are accommodated in the first and second areas 35, 36, respectively. A longitudinal direction of the agitation screws 33 is in parallel to that of the container 32, the develop roller 30 and the photoreceptor drums 18. The agitation screws 33 are rotated around the axis to deliver the developer 24 while agitating the toner and magnetic carrier.

In FIG. 2 the agitation screw 118 in the first area 35 delivers the developer 24 from one end to the other in the longitudinal direction and the agitation screw 33 in the second area 36 delivers it oppositely.

Thus, the developer supply unit 28 agitates toner supplied from one end of the first area 35 with magnetic carrier and delivers it to the other end and to the second area 36. It further agitates the toner and magnetic carrier in the second area 36 and supplies it to the surface of the develop roller 30.

The housing 29 in a box shape is attached to the container 32 of the developer supply unit 28 to cover the container 32, the develop roller 30 and else. It includes an opening 29*a* at a portion facing the photoreceptor drum 18.

The develop roller 30 being columnar is placed between the second area 36 and the photoreceptor drum 18 near the opening 125*a* in parallel to the photoreceptor drum 18 and the container 32. There is a gap between the develop roller 30 and the photoreceptor drum 18 facing each other. The gap forms a develop area 37 in which an electrostatic latent image is developed by attracting the toner in the developer 24 and a toner image is generated.

Figure 4:
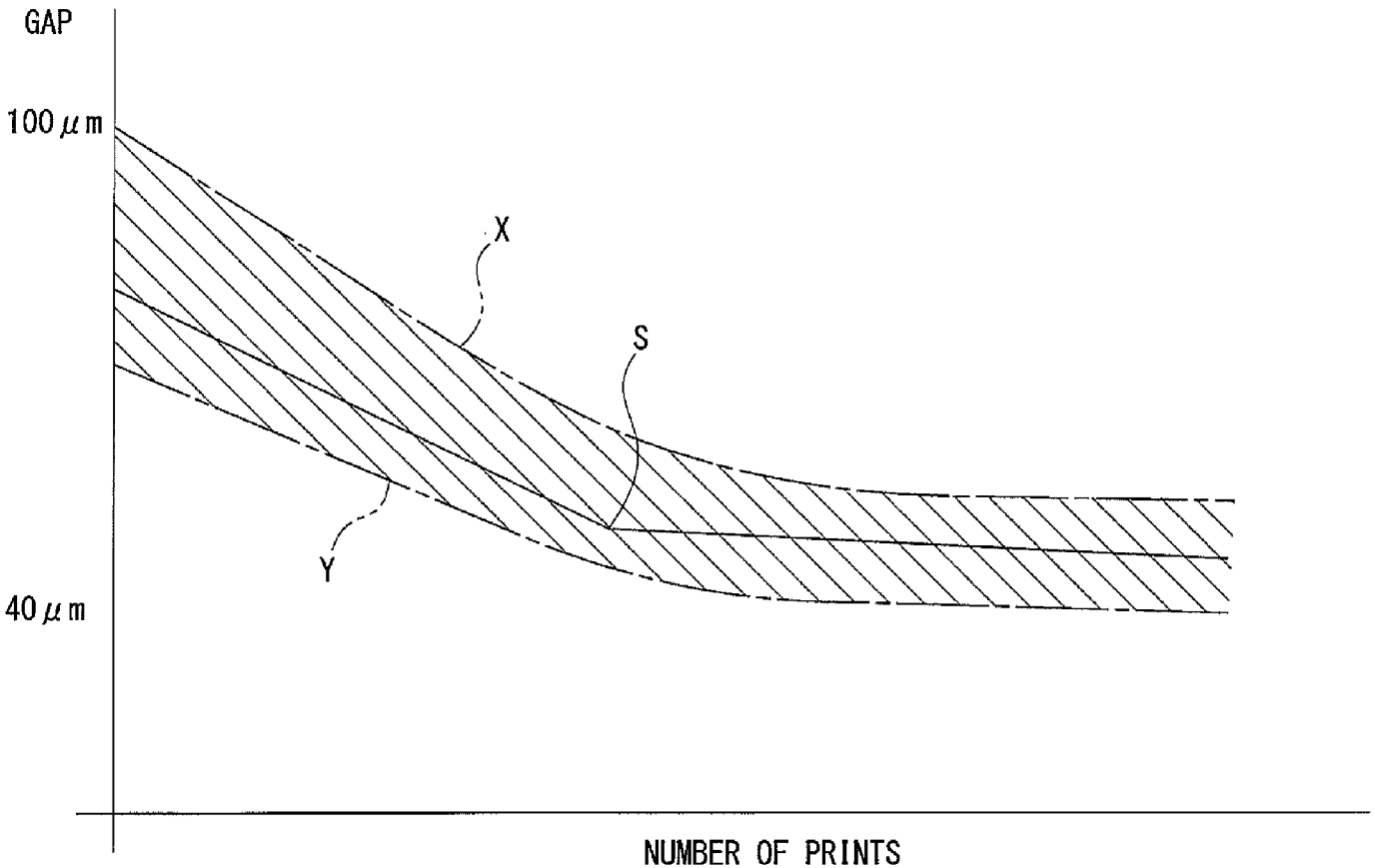
FIG. 4 shows a relation between a number of prints with the charge roller in FIG. 3A and a gap between the roller body and the photoreceptor drum.

In FIG. 4 the develop roller 30 comprises a develop sleeve 39 and a magnet roller 38. The magnet roller 38 is parallel to the photoreceptor drum 18 in a longitudinal direction, supported by the housing 29 and does not rotate. It comprises a plurality of fixed magnetic poles extending straight longitudinally on an outer circumference. The fixed magnetic poles attract the developer 24 onto the surface of develop sleeve 39.

The develop sleeve 39 contains the magnet roller 38 having a main magnetic pole and the fixed magnetic poles and rotates therearound. It is made of non-magnetic materials as aluminum alloy, brass, stainless steel (SUS) and conductive resin.

The doctor blade is provided at an end of the develop unit 20 closer to the photoreceptor drum 18, and attached to the housing 29 with a distance from the outer face of the develop sleeve 39. It adjusts an amount of the developer on the develop sleeve 39 to a desired amount by partially removing it in the container 32.

In the develop unit 20 the developer supply unit 28 sufficiently agitates the toner and the magnetic carrier and the developer is attracted onto the outer face of the develop sleeve 39 by the fixed magnetic poles. Along with the rotation of the develop sleeve 39, the developer attracted by the fixed magnetic poles are delivered to the develop area 37. The developer of a desired amount adjusted by the doctor blade is attracted onto the photoreceptor drum 18. Thus, the developer is held on the develop roller 30 and delivered to the develop area 131 to develop an electrostatic latent image on the image formed area R1 of the photoreceptor drum 18 and generate a toner image.

Then, used developer 24 is dropped in the container 32, accumulated and agitated with unused developer again in the second area 36 and used for developing an electrostatic latent image on the photoreceptor drum 18. When a toner density sensor detects a decrease in toner density supplied to the photoreceptor drum 18, the agitation screws 33 start rotating to deliver the toner to the develop roller 30.

The lubricant coating unit 21 in FIG. 2 comprises a case 40, a coating roller 41, a solid lubricant 42, and a coating blade 43.

The case 40 is accommodated in the cartridge case 16 in such a position that the photoreceptor drum 18 is placed between the case 40 and the develop unit 20. The coating roller 41 is in parallel to the photoreceptor drum 18 and contacts therewith. It includes a core entirely covered with fibers and is rotatably supported by the case 40. It rotates around the axis to scrape off a part of the solid lubricant 42 and coat the surface of the photoreceptor drum with the lubricant.

The solid lubricant 42 is formed in a cubic shape in parallel to the photoreceptor drum 18 and the coating roller 41 in the longitudinal direction. It is made of generally used lubricant materials. Preferably, it can be made of lubricant materials such as solid melamine cyanurate excelling in lubricity, polytetrafluoroethylene, boron nitride, metal salt of fatty acid excelling in film formation, zinc stearate. The solid lubricant 42 is biased by a not-shown spring to the coating roller 41.

The coating blade 43 is in parallel to the photoreceptor drum in the longitudinal direction and can be made of elastic synthetic resins such as urethane resin, silicone resin, fluorine resin but urethane resin is preferable in terms of abrasion resistance and mechanical strength. Generally, it is produced by forming a sheet of elastic synthetic resin by centrifugal molding and cutting it into a blade.

The coating blade 43 is fixed on the sidewall of the coating case 40 closer to the charge unit 17 via a blade support element 57 made of materials selected from metal, plastic, and ceramic. The materials of the blade support element 57 are arbitrarily selectable. It is elastically deformed to contact with the surface of the photoreceptor drum 18 at a predetermined pressure. It is of a so-called counter type to contact with the photoreceptor drum 18 against the rotation thereof and thinly spread the solid lubricant on the photoreceptor drum 18.

The charge unit 17 in FIG. 2 is provided between the lubricant coating unit 21 and the develop unit 20 above the photoreceptor drum 8, and comprises a charge roller 22, springs 45 (FIG. 3A), a cleaning roller pair 23, and a not-shown power source. The charge roller 22 is in parallel to the photoreceptor drum and is separable or approachable from/to the photoreceptor drums 18 and comprises a body 46 and a pair of gap retainer units 47.

Figure 3A:
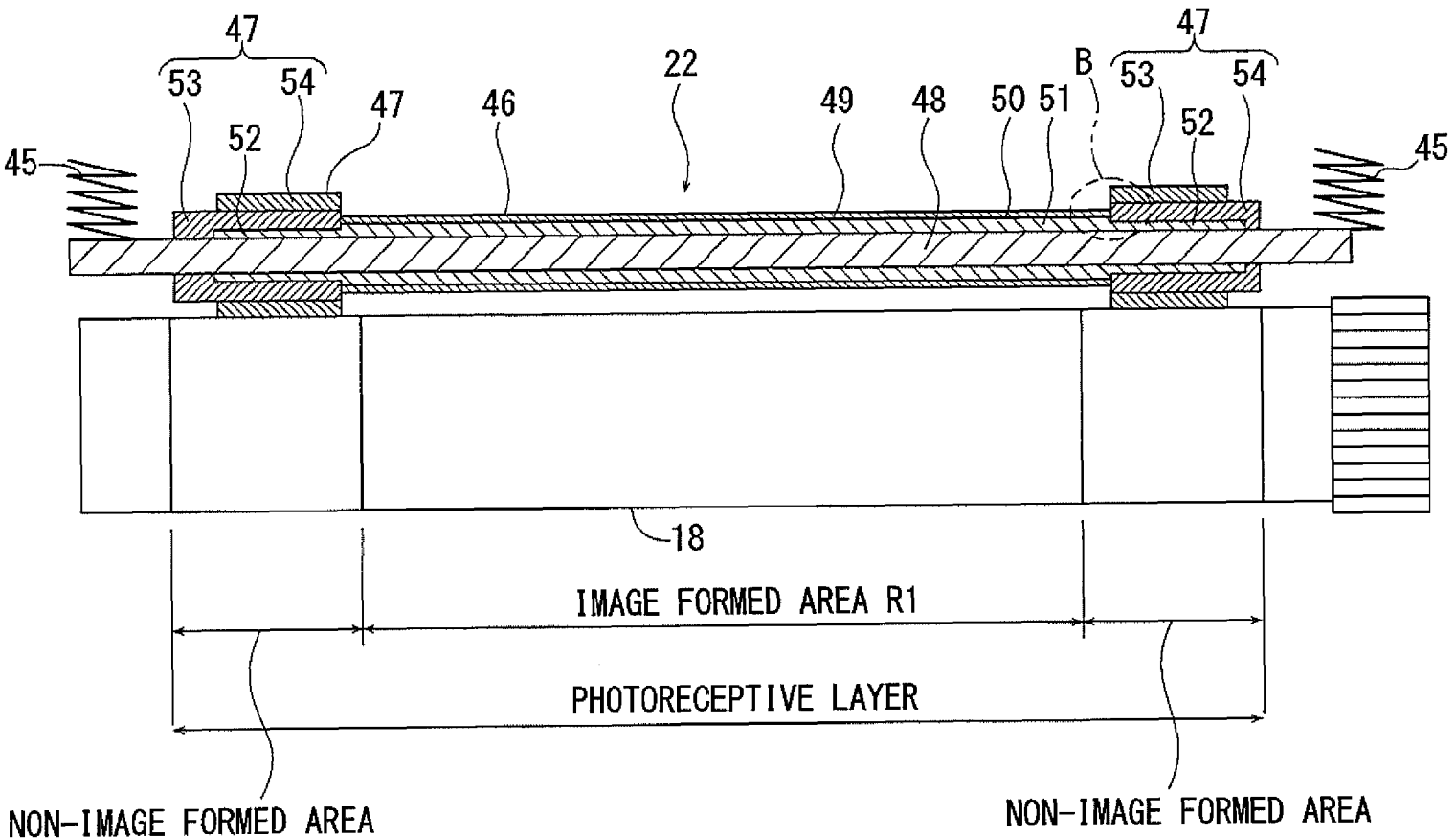
FIG. 3A cross-sectionally shows a charge roller of the process cartridge in FIG. 2
Figure 3B:
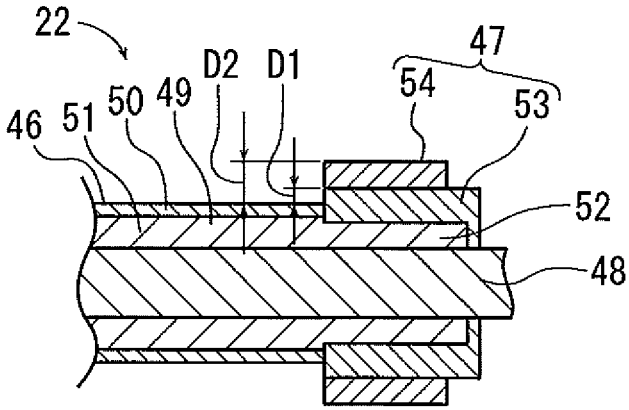
FIG. 3B is an enlarged view of a portion B of FIG. 3A.

The body 46 in FIGS. 3A, 3B comprises a metal core 48, an electric resistant layer 49 surrounding the center of the metal core 48, and a surface layer 50.

The metal core 48 is columnar and made of a conductive metal. The electric resistant layer 49 is coaxial with the metal core 48, surrounds the center of the metal core 48 in a longitudinal direction and integrally comprises a large diameter portion 51 in the center and a pair of small diameter portions 52 connecting with both ends of the large diameter portion 51 and whose diameter is smaller than that of the large diameter portion 51. The diameters of the large and small diameter portions 51, 52 are constant in the longitudinal direction. The large diameter portion 51 is longer than the image formed area R1 on the photoreceptor drum 18 and both ends thereof are outside both ends of the image formed area R1.

The electric resistant layer 49 is formed of a thermoplastic resin composition in which ionic conductive polymer is dispersed. It is preferable to form the electric resistant layer 49 with materials having volume resistivity of $10^{-5}$ to $10^{-9}$ Ωcm. This is because materials with volume resistivity of less than $10^{-9}$ Ωcm cannot exert sufficient chargeability or transferability while materials with volume resistivity of more than $10^{-5}$ Ωcm causes leak currents due to voltage convergence on the photoreceptor drum 18.

An arbitrary thermoplastic resin composition can be used for the electric resistant layer 49, however, general resins such as polyethylene (PE), polypropylene (PP), polymethyl metacrylate (PMMA), polysthylene (PS) and their copolymer (AS, ABS), polyamide, polycarbonate (PC) are preferable owing to their manageability for molding. Polymer compound containing polyetherester amide is preferable for the ionic conductive polymer dispersed in the thermoplastic resin composition. Polyetherester amide is an ionic conductive material and evenly dispersed and immobilized in matrix polymer in molecular level, therefore, there is no deviation in resistance value due to insufficient dispersion unlike a compound in which electron-conductive agent as metal oxide or carbon black is dispersed.

Applied with a high voltage, paths through which electricity easily flow are locally formed in an electron-conductive agent. This may cause a leak current to the photoreceptor drum 18 and generation of a defective image including white or black dots with the charge roller 22. Polyetherester amide is a polymer and unlikely to bleed out. Compound rate of the electric resistant layer 49 need be 20 to 70 weight % of thermoplastic resin and 80 to 20 weight % of ionic conductive polymer in order to set a desired resistance value.

Further, it is possible to add electrolyte salt in the electric resistant layer 49 for the purpose of adjusting the resistance value. Salt such as alkali metal salt including sodium perchlorate, quaternary phosphonium salt including lithium perchlorate, ethyl triphenyl phosphoniumtetra fluoroborate can be used. The plurality of conductive agents can be mixed as long as physicality is not impaired.

To evenly microdisperse a conductive material in matrix polymer at molecule level, a compatibilizing agent is added in the ionic conductive polymer. Additionally, additives as antioxidant can be also used as long as physicality is not impaired.

The resin compound can be produced arbitrarily. It is easy to produce the resin compound by mixing materials and melting and kneading them by a twin screw compounding extruder or a twin screw kneading extruder. Also, it is easy to form the electric resistant layer 49 on the metal core 48 by covering it with the ionic conductive resin compound by extrusion or injection molding.

The surface layer 50 is formed on the electric resistant layer 49 of the metal core 48 in order to prevent toner and toner additives from attaching to the electric resistant layer 49, reducing chargeability.

The surface layer 50 is formed in uniform thickness in both of longitudinal and circumferential directions to cover the large diameter portion 51 of the electric resistant layer 49. It is preferably made of fluorite resin, silicon resin, polyamide resin, polyester resin or the like since they can prevent toner attachment owing to their good non-adherence. The surface layer 50 can be formed by dissolving materials in organic solvent to produce paint and coating the paint by spraying, dipping, roll coating or the like. The thickness of the layer is preferably about 10 to 30 μm.

The surface layer 50 made of two-component paint together with a curing agent excels in environment resistance, non-adherence and mold releasability. Two component paint of a base agent containing hydroxyl in molecules and isocyanate resin producing cross-linking reaction with the hydroxyl is effective. Use of isocyanate resin induces cross-linking and curing reaction at a relatively low temperature of 100 degrees or less. Cross-linking density of the surface can be freely adjusted by changing the amount of curing agent relative to 1 functional group (OH group) equivalent.

Silicon resin, silicon, and grafted fluorine resin are good materials for the surface layer 50 with toner non-adherence taken into consideration.

Since electric property (resistance) of the charge roller 22 is important, the surface layer 50 needs to be conductive. It can be made ionic conductive by dispersing electrolyte salt in resin materials. Alkali metal chloride such as sodium perchlorate, lithium perchlorate, calcium perchlorate, lithium chloride, fluorine containing organic anion salt as quaternary phosphonium salt such as alkaline-earth metal salt, lithium bis(trifluoromethanesulfonyl)imide, lithium tris(trifluoromethanesulfonyl)methane, lithium trifluoromethanesulfonate, tyltriphenylphosphonium tetrafluoroborate, tetraphenylphosphonium bromide, modified aliphatic ethyldimethyl ammonium ethyl sulfate, stearic acid ammonium acetate, lauryl ammonium acetate can be used. Especially, lithium bis(trifluoromethanesulfonyl)imide, lithium tris(trifluoromethanesulfonyl), and methane lithium trifluoromethanesulfonate realize low resistance of the charge roller 22.

To realize low resistance of the ionic conductive materials, polyether polyol type (ether oxygen) comprising polyethylene oxide, polypropylene oxide, or copolymer thereof is also needed. Polyether polyol preferably accounts for 20 to 70 weight % of the entire resin forming the surface layer (coating film), most preferably 35 to 55 weight %. Amount of polyether oxygen in polyether polyol is preferably 40 weight % or more in ethylene oxide amount (EO). A product of rate of polyether polyol resin and EO need be 25 weight % or more, preferably 45 weight % or more.

Additive amount of electrolyte salt is preferably 1 to 15 weight % of the entire resin forming the coating film, and most preferably 1.5 to 10 weight %. Plural kinds of electrolyte salt can be mixed as long as physicality is not impaired.

The gap retainer units 47 are provided at ends of the metal core 48 and around the small diameter portion 52 of the electric resistant layer 49, that is, on both ends of the roller body 46. The gap retainer units 47 are in an opposite position to non-image formed areas R2 (FIG. 3A) which are continuous with the image formed area R1 and on which no electrostatic latent image is formed.

The gap retainer units 47 are coaxial with the metal core 48 and the electric resistant layer 49 and each comprise first and second gap retainer elements 53, 54 coaxial with each other. The first gap retainer element 53 is provided at end of the metal core 48 and on the small diameter portion 52 (roller body) of the electric resistant layer 49 and the diameter thereof is slightly larger than that of the surface layer 50 on the large diameter portion 51. That is, a step D1 in height of 40 to 60 μm is formed between the first gap retainer element 53 and the surface layer 50 as shown in FIG. 3B.

The second gap retainer element 54 is provided on the first gap retainer element 53 and the diameter thereof is slightly larger than that of the first gap retainer element 53. That is, a step D2 in height about 100 μm (preferably 60 μm or more 100 μm or less) is formed between the second gap retainer element 54 and the surface layer 50 as shown in FIG. 3B.

The gap retainer units 47 configured as above contact with the non-image formed areas R2 on the photoreceptor drum 18 when the metal core 48 is biased to the photoreceptor drum 18. Thereby, a gap between the surface layer 50 of the roller body 46 and the photoreceptor drum 18 coincides with the height of the step D2 (about 100 μm for example) and is constantly maintained when the charge roller 22 rotates together with the photoreceptor drum 18. The second gap retainer element 54 is made of a materials softer than those (polycarbonate for example) of the first gap retainer element 53 and the surface layer of the photoreceptor drum 18 as later described. Therefore, it is gradually abraded over time as the number of prints increases. When the second gap retainer element 54 is completely abraded, the first gap retainer element 53 contacts with the photoreceptor drum 18 and the gap between the surface layer 50 of the roller body 46 and the photoreceptor drum 18 is maintained at the height of the step D1, 40 to 60 μm, for example.

Thus, either of the first and second gap retainer elements 53, 54 contacts with the non-image formed areas R2 on the photoreceptor drum 18 to maintain the gap between the surface layer 50 of the roller body 46 and the photoreceptor drum 18 to about 100 μm, specifically 40 to 80 μm. This can prevent generation of defective images during operation of the charge unit 17 under ambient temperature and humidity. With the gap being over 100 μm, a discharge start voltage by the Paschen's law increases and local discharge breakdown or anomalous discharge is likely to occur.

Meanwhile, with the gap being below 40 μm, the photoreceptor drum 18 can be charged with a small discharge power. However, an air flow deteriorates in a narrow space between the charge roller 22 and the photoreceptor drum 18. Because of this, a large amount of discharge product formed in a discharge area is accumulated in this space even after completion of image generation, and contaminates or adheres to the roller 22 and the photoreceptor drum 18, causing a charge failure. Accordingly, the gap between the surface layer 50 of the roller body 46 and the photoreceptor drum 18 need be 40 μm or more.

In the initial use period, the surface of the charge roller 22 is clean and free from contaminant matter so that anomalous discharge due to leak currents does not occur even with a relatively large gap. However, as the number of paper sheets on which images are generated increases over time, contaminant matter is gradually accumulated on the charge roller 22, which decreases the gap between the charge roller 22 and the photoreceptor drum 18 accordingly.

FIG. 4 shows a relation indicated by a dashed-dotted line X between the number of paper sheets 2 printed and the gap when no anomalous discharge due to leak current occurs and a relation indicated by a dashed-two-dotted line between the same and the gap when no anomalous discharge due to accumulated contaminant matter occurs. In the graph, discharge due to leak current occurs in the area above the dash-dotted line X while no discharge occurs in the area below the dash-dotted line X. Similarly, no discharge due to accumulated contaminant matter occurs in the area above the dash-two-dotted line Y while the discharge occurs in the area below the dash-two-dotted line Y.

Thus, the gap between the charge roller 22 and the photoreceptor drum 18 has to be maintained to a value in the area between the lines X and Y. Thereby, the charge roller 22 can properly charge the photoreceptor drum 18. After the initial use period, a change in the lines X and Y becomes gradual since contamination on the charge roller 22 does not increase much over time.

With the above taken into account, in the present embodiment the second gap retainer element 54 is made of easily abraded materials and the gap between the charge roller 22 and the photoreceptor drum 18 is set to be wide during the initial use period in which the chargeability of the charge roller 22 is highest. Over time the chargeability gradually decreases, the second gap retainer element 54 is abraded and the gap decreases. When the second gap retainer element 54 is completely abraded, the first gap retainer element 53 then contacts with the photoreceptor drum 18. The first gap retainer element 53 is not abraded since it is made of materials with higher hardness than those of the surface layer of the photoreceptor drum 18. Therefore, the gap between the charge roller 22 and the photoreceptor drum 18 is constantly maintained even with an increase in the number of paper sheets 2 printed over time. The gap can be constantly maintained in a state that a decrease in the chargeability of the charge roller slows down.

The gap retainer units 47 are required to stably form the gap without influenced by environment over a long period time. For this reason, it is preferable that the first and second gap retainer elements 53, 54 are made of materials of low hygroscopic nature which are free from attachment of toner and toner additive and do not abrade the photoreceptor drum. Also, it is preferable that materials of the first and second gap retainer elements 53, 54 are arbitrarily selected depending on various conditions.

Specifically, the gap retainer units 47 or the first second gap retainer elements 53, 54 are preferably made of one or more materials selected from general resin such as polyethylene (PE), polypropylene (PP), polyacetal (POM), methyl metacrylate (PMMA), polysthylene (PS) and their copolymers (AS, ABS), polycarbonate (PC), urethane, and fluorine (PTFE). Preferably, the materials of the first gap retainer element 53 are ones harder than those of the surface layer 50 of the photoreceptor drum 18 among the above-mentioned resin materials. The materials of the second gap retainer element 54 are ones softer than those of the surface layer 50 and the first gap retainer element 53.

Further, in view of preventing leak current to the photoreceptor drum 18 from occurring, the first and second gap retainer element 53, 54 are preferably made of insulating materials with volume specific resistance of 10 to 13 Ωcm or more.

The gap retainer unit 47 is formed in the following manner. First, the first gap retainer element 53 made by molding is mounted on both ends of the electric resistant layer 49 and then covered with the second gap retainer element 54. Alternatively, the second gap retainer element 54 is placed adjacent to the first gap retainer element 53 or it can be formed by coating the first gap retainer element 53 with solvent-soluble resin materials. Moreover, it is possible to increase precision of the first and second gap retainer elements 53, 54 by cutting or polishing. The gap between the charge roller 22 and the photoreceptor drum 18 can be more precisely set by concurrently processing the first and second gap retainer elements 53, 54 and the electric resistant layer 49.

Figure 5A:
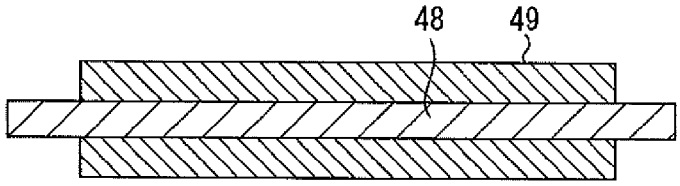
FIGS. 5A to 5F show manufacturing process of the charge roller in FIG. 3A.
Figure 5B:
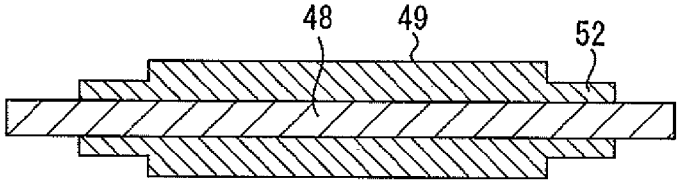
Figure 5C:
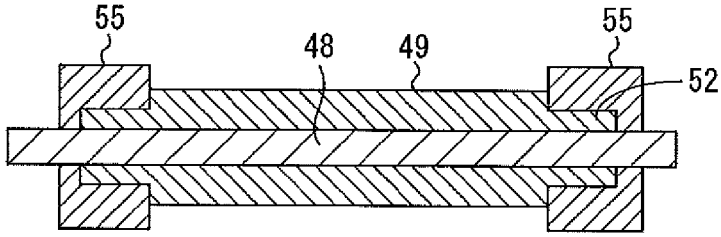
Figure 5D:
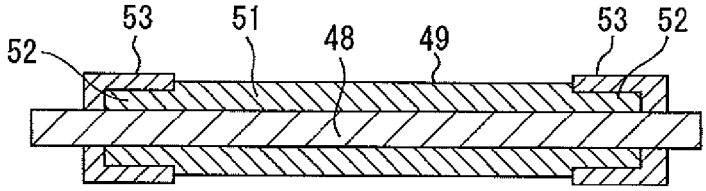
Figure 5E:
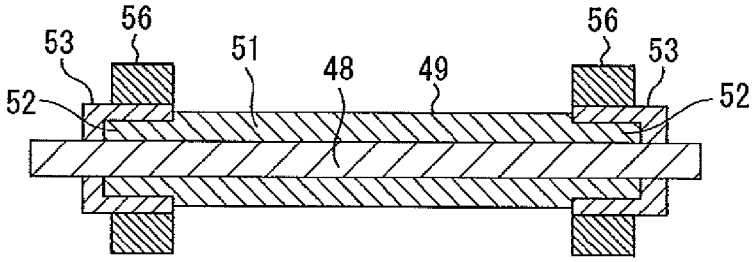
Figure 5F:
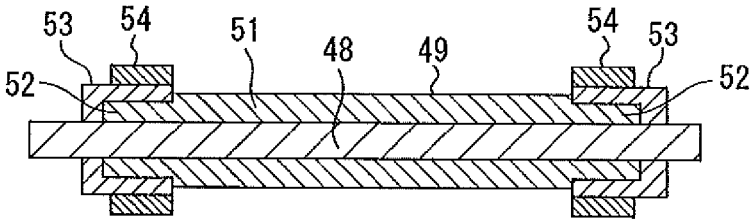

Next, the manufacture of the charge roller 22 is described with reference to FIGS. 5A to 5F. First, the electric resistant layer 49 is formed around the metal core 48 by injection molding in FIG. 5A so that outer diameter thereof is constant. In FIG. 5B both ends of the electric resistant layer 49 are cut off to create the small diameter portions 52. In FIG. 5C both ends of the metal core 48 and the small diameter portions 52 are pressed into ring portions 55 which are formed to include a hole in the same diameter as the outer diameter of the metal core 48 and step portions in the same diameter as that of the small diameter portions 52. In FIG. 5D the outer circumferences of the ring portions 55 are cut off to form the first gap retainer elements 53. Also, the outer circumference of the electric resistant layer 49 is cut off to form the large diameter portion 51. In FIG. 5E the first gap retainer elements 53 are pressed into another ring portions 56. In FIG. 5F the outer circumferences of the ring portions 56 are cut off to form the second gap retainer elements 54. Then, the surface layer 50 is formed around the large diameter portion 51 of the electric resistant layer 49 to complete the charge roller 22.

The springs 45 are provided for both ends of the metal core 48 of the charge roller 22 to bias them to both ends of the photoreceptor drum 18.

The cleaning roller pair 23 is arranged in parallel with an interval and parallel to the charge roller 22. It is rotatable around the axis and contacts with the surface of the charge roller 22. It rotates together with the charge roller 22 to remove contaminant matter from the charge roller 22.

The charge roller 22 is applied with a predetermined voltage from the power source. The applied voltage can be a direct voltage and preferably a superimposed direct and alternating voltage. This is because applied with a direct voltage, uneven potentials may occur on the surface of the photoreceptor drum 18 due to an uneven thickness of the electric resistant layer 49 and the surface layer 50. On the other hand, applied with the superimposed voltage, potentials on the surface of the charge roller 22 are even and it can stably discharge and charge the photoreceptor drum 18 evenly. A peak voltage of the direct voltage is preferably set to be twice or more the charge start voltage of the photoreceptor drum 18. The charge start voltage refers to an absolute value of a voltage at which the charge of the photoreceptor drum 18 starts when the charge roller 22 is applied with a direct voltage only. This causes a back discharge from the photoreceptor drum 18 to the charge roller 22 and a smoothing effect to evenly stably charge the photoreceptor drum 18. The frequency of the alternating voltage is preferably 7 times or more the rotation speed of the photoreceptor drum 18, thereby preventing viewable moire images.

The charge unit 17 is configured that the charge roller 22 can continuously contact with the photoreceptor drum 18 by the bias force of the springs 45 even though the second gap retainer elements 54 are abraded as the number of prints increases over time. In FIG. 4 when the number of paper sheets 2 printed (number of images generated) is over the point S (at which a change in the lines X, Y gets gradual; the number of prints is 200K in the drawing), the second gap retainer element 54 is completely abraded and does not exist anymore. Instead, the first gap retainer element 53 contacts with the photoreceptor drum 18 to constantly maintain the gap. In FIG. 4 the gap is 70 μm indicated by the solid line when an image is generated on a first sheet of paper 2, and it gradually decreases over time and becomes constant at about 50 μm after the point S.

Next, image generation of the image forming apparatus 1 is described. First, the photoreceptor drum 18 is rotated and evenly charged with the charge roller 22 at −700V. Then, the photoreceptor drum 18 is exposed with laser and a voltage of an image portion thereon turns to −150V to generate an electrostatic latent image. The electrostatic latent image is applied with a bias voltage of −550V and developed in the develop area 37 by attracting toner of the developer 24 from the develop roller 30 of the develop unit 20. Thus, a toner image is generated on the photoreceptor drum 18.

The toner image is transferred onto the paper sheet 2 fed by the feed roller 11 and else between each photoreceptor drum 18 and the transfer belt 14. The fuse unit 7 fuses the toner image to generate a color image on the paper sheet 2.

Remnant toner T on the photoreceptor drum 18 is recovered by the cleaning roller. The toner-free photoreceptor drum 18 is neutralized by a not-shown neutralizer and coated with a part of the solid lubricant 42 by the lubricant coating unit 21. Then, it is charged with the charge unit 17 again for the next image generation.

The image forming apparatus 1 performs a process control to prevent a variation in image quality due to environmental or temporal change. Specifically, it comprises a not-shown optical sensor detecting image density of a toner pattern which is formed on the photoreceptor drum under a condition that a bias voltage is constant, to detect develop performance of the develop unit 20 from a density change. A target toner density is changed to adjust the develop performance to a preset target performance, thereby maintaining constant image quality. For example, when the detected image density of a toner pattern is lower than a target toner density, a not-shown controller (CPU) controls a drive circuit for a motor agitating the developer to increase the toner density. When the detected image density is higher than the target toner density, the CPU controls the drive circuit to decrease the toner density. The toner density is detected by a not-shown toner density sensor. The image density of the toner pattern on the photoreceptor drum 18 may slightly vary because of a periodic unevenness in the image density caused by the develop roller 30.

According to the image forming apparatus 1 in the present embodiment, the second gap retainer element is made of a material softer than those of the first gap retainer element 53 and the surface layer of the photoreceptor drum 18 and configured to be gradually abraded especially in the initial use period as the rotation of the charge roller 22 increases. The gap between the roller body 46 and the second gap retainer element 54 is decreased accordingly. This makes it possible to prevent occurrence of anomalous discharge due to leak current even when the roller body gradually gets contaminated as the number of prints increases in the initial use period.

Furthermore, the first gap retainer element 53 is made of a material harder than that of the surface layer of the photoreceptor drum 18. Therefore, it is never abraded by contacting with the photoreceptor drum 18 after the second gap retainer element 54 is entirely abraded. After the initial use period in which the second gap retainer element 54 has contacted with the photoreceptor drum 18, once the first gap retainer element 53 contacts with the photoreceptor drum 18, the gap between the roller body 46 and the photoreceptor drum 18 is constantly maintained irrespective of an increase in the number of paper sheets 2 printed. In addition, contamination on the roller body 46 is not increased after the initial use period so that it is possible for the charge roller to stably charge the photoreceptor drum 18 without failure.

The first gap retainer element 53 is made of a material whose durometer hardness is larger than 55 selected from general resin as high density polyethylene, polypropylene (PP), polyacetal (POM), polymethylmethacrylate (PMMA), polysthylene and their copolymers (AS, ABS) and polycarbonate (PC). This makes it possible to surely maintain the gap between the roller body 46 and the photoreceptor drum 18 constantly irrespective of an increase in the number of paper sheets 2 printed.

The second gap retainer element 54 is made of a material whose durometer hardness is smaller than 50 selected from low density polyethylene, soft polypropylene, a fluoric resin layer (fluorocarbon polymer layer) containing FEP, PTFE. Because of this, during the initial use period it is gradually abraded contacting with the photoreceptor drum 18 as the number of prints increases so that the gap between the roller body 46 and the photoreceptor drum 18 is surely decreased accordingly.

The process cartridges 9Y, 9M, 9C, 9K and the image forming apparatus 1 according to the present embodiment comprise the above charge unit 17. Therefore, it can prevent occurrence of anomalous discharge due to leak current even with a gradual contamination on the roller body 46 as the number of prints increases since the roller body 46 gradually approaches the photoreceptor drum 18.

In the present embodiment described above the second gap retainer element 54 is formed by cutting the outer circumference of the ring portions 56, for example. However, the present invention should not be limited to such an example. Alternatively, it can be formed by adhering a sheet onto the outer circumference of the first gap retainer element 53 or coating it with resin.

The inventors of the present invention produced several samples of the charge roller 22 according to the present embodiment and conducted experiment to confirm their effects. The results are shown in the following Table.

TABLE

| Samples | White Dots in Initial State | Image Quality after 500,000 copies | Gap Retainer Element after 500,000 copies | Total Evaluation |
|---|---|---|---|---|
| A | Good | Good | Good | Good |
| B | Good | Good | Good | Good |
| C | Good | Good | Good | Good |
| D | Good | Good | Good | Good |
| E | Good | Good | Good | Good |
| F | Poor | Poor | — | Poor |
| G | Good | Poor | — | Poor |

In this experiment the inventors generated images on the paper sheets 2, using the sample rollers A to G and checked occurrence of white dots, anomalous discharge due to leak current, image quality on the 500,000$^{th}$ paper sheet 2 and the state of the charge roller 22 (gap retainer element) after 500,000 paper sheets are printed. The sample rollers F, G are not according to the present invention and produced for comparison. Results are indicated by "Good", "Poor" in the Table. The sample rollers were applied with a direct voltage of −700V and an alternating voltage of 2.2 kVpp (at frequency of 2 kHz) under ambient condition of temperature 23 degrees, humidity 60% RH.

The sample A was produced in the following manner. First, 25 weight % of ABS resin (GR-3000 by Denki Kagaku Kogyo Kabushiki Kaisha) and 75 weight % of polyether ester amide (IRGASTAT, P18 by BASF) were blended to acquire a resin compound. Polycarbonate glycidyl methacrylate acrylonitrile copolymer (Modiper CL440-G by NOF Corporation) of 4 pts·wt. was added to 100 pts·wt. of the resin compound and melted and kneaded to acquire a molten resin compound. The electric resistant layer 49 in outer diameter 13 mm was produced by injection molding of the molten resin compound on the metal core 48 in outer diameter 10 mm made of Ni coated free cutting steels (SUM). Then, the small diameter portions 52 were formed at both ends of the electric resistant layer 49 and pressed into the ring portions 55 together with both ends of the metal core 48. The ring portions were in outer diameter 13 mm, inner diameter 12 mm and made of high density polyethylene (NOVATEC HD, HY540 by Japan Polychem Co.). By cutting the ring portions 55, the first gap retainer elements 53 in outer diameter 12.60 mm and the large diameter portion 51 in outer diameter 12.46 mm of the electric resistant layer 49 were obtained. The first gap retainer elements 53 were pressed into the ring portions 56 in outer diameter 13 mm, inner diameter 12.6 mm made of low density polyethylene (NOVATEC LD, LJ902 by Japan Polychem Co.). By cutting the ring portions 56, the second gap retainer elements 54 in outer diameter 12.64 mm were obtained. The surface of the large diameter portion 51 was spray-coated in thickness of 20 μm with paint including 20 pts·wt. of toner non-adherent acrylic modified silicone resin (3000VH-P by Kawakai Paint MFG Co., Ltd.), 50 pts·wt. of polyetherpolyol resin (E504 by Asahi Glass Co., Ltd), 24 pts·wt. of isocyanate curing agent (T4 by Kawakami Paint MFG Co., Ltd.), 5.5 pts·wt. of lithium bis(trifluoromethanesulfonyl)imide butyl acetate solvent (by Sanko Chemical Ind. Co., Ltd) as electrolyte salt, 0.5 pts·wt. of organochloride catalyser (U-CAT-SA1 by San-Apro Ltd.), 0.5 pts·wt. of butyl acetate molten carbon black dispersion (REC-SM23 by Resino Color Industry Co. Ltd.) and whose solid components had been conditioned in a diluted solvent of butyl acetate and methyl ethyl ketone (MEK). Then, it was heated at temperature of 100 degrees in 1.5 hours to form the surface layer 50 by hardening the coating. Thus, the sample A of the charge roller 22 with a step of 70 μm between the second gap retainer elements 54 and the electric resistant layer 49 and a step of 50 μm between the first gap retainer elements 53 and the electric resistant layer 49 was obtained.

The sample B was produced in the following manner. First, as in the sample A, the electric resistant layer 49 in outer diameter 13 mm was formed on the metal core 48 of Ni coated SUM in outer diameter 10 mm. The small diameter portions 52 were formed at both ends of the electric resistant layer 49 and pressed into the ring portions 55 in outer diameter 13 mm, inner diameter 12 mm of high density polyethylene (NOVATEC HD, HY540 by Japan Polychem Co.) together with both ends of the metal core 48. By cutting the ring portions 55, the first gap retainer elements 53 in outer diameter 12.60 mm and the large diameter portion 51 in outer diameter 12.46 mm were obtained. A low density polypropylene (NOVATEC LL, UF240 by Japan Polychem Co.) film (containing adhesive component) in thickness 20 μm was adhered onto the outer circumferences of the first gap retainer elements 53 to form the second gap retainer elements 54. The surface layer 50 was then formed in the same manner as that of the sample A. Thus, the sample B of the charge roller 22 with a step of 70 μm between the second gap retainer elements 54 and the electric resistant layer 49 and a step of 50 μm between the first gap retainer elements 53 and the electric resistant layer 49 was obtained.

The sample C was produced in the following manner. First, as in the sample A, the electric resistant layer 49 in outer diameter 13 mm is formed on the metal core 48 of Ni coated SUM in outer diameter 10 mm. The small diameter portions 52 are formed at both ends of the electric resistant layer 49 and pressed into the ring portions 55 in outer diameter 13 mm, inner diameter 12 mm of high density polyethylene (NOVATEC HD, HY540 by Japan Polychem Co.) together with both ends of the metal core 48. By cutting the ring portions 55, the first gap retainer elements 53 in outer diameter 12.60 mm and the large diameter portion 51 in outer diameter 12.42 mm were obtained. The first gap retainer elements 53 were pressed into the ring portions 56 made of fluorinate resin (Neo Flon NP-20 by Daikin Industries Ltd.) in outer diameter 13 mm, inner diameter 12.4 mm. By cutting the ring portions 56, the second gap retainer elements 54 in outer diameter 12.55 mm were formed. The surface layer 50 was then formed in the same manner as that of the sample A. Thus, the sample C of the charge roller 22 with a step of 70 μm between the second gap retainer elements 54 and the electric resistant layer 49 and a step of 50 μm between the first gap retainer elements 53 and the electric resistant layer 49 was obtained.

The sample D was produced in the following manner. First, as in the sample A, the electric resistant layer 49 in outer diameter 13 mm was formed on the metal core 48 of Ni coated SUM in outer diameter 10 mm. The small diameter portions 52 were formed at both ends of the electric resistant layer 49 and pressed into the ring portions 55 in outer diameter 13 mm, inner diameter 12 mm of high density polyethylene (NOVATEC HD, HY540 by Japan Polychem Co.) together with both ends of the metal core 48. By cutting the ring portions 55, the first gap retainer elements 53 in outer diameter 12.60 mm and the large diameter portion 51 in outer diameter 12.46 mm were obtained. A flexible polypropylene (Newcon R-type by Japan Polychem Co.) film (containing adhesive components) in thickness 20 μm was adhered onto the outer circumferences of the first gap retainer elements 53 to form the second gap retainer elements 54. The surface layer 50 was then formed in the same manner as that of the sample A. Thus, the sample D of the charge roller 22 with a step of 70 μm between the second gap retainer elements 54 and the electric resistant layer 49 and a step of 50 μm between the first gap retainer elements 53 and the electric resistant layer 49 was obtained.

The sample E was produced in the following manner. First, as in the sample A, the electric resistant layer 49 in outer diameter 13 mm was formed on the metal core 48 of Ni coated SUM in outer diameter 10 mm. The small diameter portions 52 were formed at both ends of the electric resistant layer 49 and pressed into the ring portions 55 in outer diameter 13 mm, inner diameter 12 mm of high density polyethylene (NOVATEC HD, HY540 by Japan Polychem Co.) together with both ends of the metal core 48. By cutting the ring portions 55, the first gap retainer elements 53 in outer diameter 12.60 mm and the large diameter portion 51 in outer diameter 12.46 mm were obtained. The outer circumferences of the first gap retainer elements 53 were coated with a primer and a fluorinate resin (ZX-022 by Fuji Kasei Kogyo Co., Ltd.) in thickness 20 μm and then cross-linked with isocyanate to form the second gap retainer elements 54. The surface layer 50 was then formed in the same manner as that of the sample A. Thus, the sample E of the charge roller 22 with a step of 70 μm between the second gap retainer elements 54 and the electric resistant layer 49 and a step of 50 μm between the first gap retainer elements 53 and the electric resistant layer 49 was obtained.

The sample F for comparison was produced in the following manner. First, as in the sample A, the electric resistant layer 49 in outer diameter 13 mm was formed on the metal core 48 of Ni coated SUM in outer diameter 10 mm. The small diameter portions 52 were formed at both ends of the electric resistant layer 49 and pressed into the ring portions 55 in outer diameter 13 mm, inner diameter 12 mm of high density polyethylene (NOVATEC HD, HY540 by Japan Polychem Co.) together with both ends of the metal core 48. By cutting the ring portions 55, the first gap retainer elements 53 in outer diameter 12.70 mm and the large diameter portion 51 in outer diameter 12.42 mm were obtained. The surface layer 50 was then formed in the same manner as that of the sample A. Thus, the sample F of the charge roller 22 with a step of 120 μm between the first gap retainer elements 53 and the electric resistant layer 49 was obtained.

The sample G for comparison was produced in the following manner. First, as in the sample A, the electric resistant layer 49 in outer diameter 13 mm was formed on the metal core 48 of Ni coated SUM in outer diameter 10 mm. The small diameter portions 52 were formed at both ends of the electric resistant layer 49 and pressed into the ring portions 55 in outer diameter 13 mm, inner diameter 12 mm of high density polyethylene (NOVATEC HD, HY540 by Japan Polychem Co.) together with both ends of the metal core 48. By cutting the ring portions 55, the first gap retainer elements 53 in outer diameter 12.2 mm and the large diameter portion 51 in outer diameter 12.42 mm were obtained. The surface layer 50 was then formed in the same manner as that of the sample A. Thus, the sample G of the charge roller 22 with a step of 30 μm between the first gap retainer elements 53 and the electric resistant layer 49 was obtained.

As shown in the Table, white dotted images occurred due to an anomalous discharge by leak current using the samples F, G while they did not using the samples A to E according to the present embodiment. Similarly, using the samples F, G, color and black dotted images and images with unintended lines occurred on the 500,000$^{th}$ sheet of paper 2 due to uneven discharge by accumulated contaminant while they did not at all, using the samples A to E according to the present embodiment.

The above embodiment has described an example of the image forming apparatus 1 comprising the process cartridges 9Y, 9M, 9C, 9K detachable from the body 3 and each including the cartridge case 16, charge unit 17, photoreceptor drum 18, cleaning unit 19, and develop unit 20. However, the present invention should not be limited to such an example. The process cartridge has only to include the develop unit 20. Moreover, the image forming apparatus 1 has only to include the charge unit 17 and can exclude the process cartridges 9Y, 9M, 9C, 9K.

Although the present invention has been described in terms of exemplary embodiments, it is not limited thereto. It should be appreciated that variations or modifications may be made in the embodiments described by persons skilled in the art without departing from the scope of the present invention as defined by the following claims.

What is claimed is:

1. A charge element comprising:

an element body in parallel to a photoreceptor element and biased to the photoreceptor element by an elastic element; and a gap retainer unit provided on the element body, contacting with an outer face of the photoreceptor element to constantly retain a gap between an outer face of the element body and the outer face of the photoreceptor element, and comprising a first gap retainer element provided on the element body and a second gap retainer element provided on the first gap retainer element and made of a material softer than that of the first gap retainer element and that of the outer face of the photoreceptor element.

2. A charge element according to claim 1, wherein the first gap retainer element is made of a material harder than that of the outer face of the photoreceptor element.

3. A charge element according to claim 1, wherein the first gap retainer element is made of a material whose durometer hardness is 55 or more selected from high density polyethylene, polypropylene, polyacetal, polymethylmetacrylate, polysthylene and their copolymers, and polycarbonate.

4. A charge element according to claim 1, wherein the second gap retainer element is made of one or more materials whose durometer hardness is 50 or smaller selected from low density polyethylene, soft polypropylene, and a fluoric resin layer of FEP and PTFE.

5. A process cartridge comprising:

a photoreceptor element on which an electrostatic latent image is formed;

a charge element according to claim 1, charging an outer face of the photoreceptor element;

a develop unit developing the electrostatic latent image on the photoreceptor element; and a cleaning unit removing remnant toner from the outer face of the photoreceptor element.

6. An image forming apparatus comprising:

a photoreceptor element on which an electrostatic latent image is supported;

a charge element according to claim 1 charging an outer face of the photoreceptor element;

a develop unit developing the electrostatic latent image on the photoreceptor element; and a cleaning unit removing remnant toner from the outer face of the photoreceptor element.

7. A charge element comprising:

an element body in parallel to a photoreceptor element and biased to the photoreceptor element by an elastic element; and a gap retainer unit provided on the element body, contacting with an outer face of the photoreceptor element to constantly retain a gap between an outer face of the element body and the outer face of the photoreceptor element, and comprising a first gap retainer element provided on the element body to create a first gap between the element body and the photoreceptor element and a second gap retainer element provided on the first gap retainer element to create a second gap between the element body and made of a material softer than that of the first gap retainer element and that of the outer face of the photoreceptor element.

8. A process cartridge comprising:

a photoreceptor element on which an electrostatic latent image is formed;

a charge element according to claim 7, charging an outer face of the photoreceptor element;

a develop unit developing the electrostatic latent image on the photoreceptor element; and a cleaning unit removing remnant toner from the outer face of the photoreceptor element.

9. An image forming apparatus comprising:

a photoreceptor element on which an electrostatic latent image is supported;

a charge element according to claim 7 charging an outer face of the photoreceptor element;

a develop unit developing the electrostatic latent image on the photoreceptor element; and a cleaning unit removing remnant toner from the outer face of the photoreceptor element.

* * * * *